US009080543B2

(12) United States Patent
Seillier et al.

(10) Patent No.: US 9,080,543 B2
(45) Date of Patent: Jul. 14, 2015

(54) COMBUSTION ENGINE STARTER WITH OUTPUT PINION

(75) Inventors: Guillaume Seillier, La Verpilliere (FR); Laurent Boisserenq, Bourgoin Jallieu (FR)

(73) Assignee: Valeo Equipements Electriques Moteur, Créteil Cedex (FR)

( * ) Notice: Subject to any disclaimer, the term of this patent is extended or adjusted under 35 U.S.C. 154(b) by 218 days.

(21) Appl. No.: 13/582,806

(22) PCT Filed: Mar. 15, 2011

(86) PCT No.: PCT/FR2011/050513

§ 371 (c)(1),
(2), (4) Date: Dec. 20, 2012

(87) PCT Pub. No.: WO2011/114052

PCT Pub. Date: Sep. 22, 2011

(65) Prior Publication Data

US 2013/0091967 A1 Apr. 18, 2013

(30) Foreign Application Priority Data

Mar. 19, 2010 (FR) ..... 10 51975

(51) Int. Cl.

| | |
|---|---|
| ***F02N 15/00*** | (2006.01) |
| ***F02N 15/04*** | (2006.01) |
| ***F02N 15/06*** | (2006.01) |
| *F02N 11/00* | (2006.01) |

(52) U.S. Cl.

CPC ..... *F02N 15/06* (2013.01); *F02N 15/065* (2013.01); *F02N 11/00* (2013.01); *F02N 15/00* (2013.01); *F02N 15/063* (2013.01); *Y10T 74/13* (2015.01)

(58) Field of Classification Search

CPC .. F02N 15/063; F02N 15/02; F02N 2015/061
USPC ..... 74/6, 7 A, 7 R
See application file for complete search history.

(56) References Cited

U.S. PATENT DOCUMENTS

| | | | | |
|---|---|---|---|---|
| 4,818,889 | A * | 4/1989 | Kinoshita | 290/48 |
| 4,860,604 | A * | 8/1989 | Kinoshita | 74/7 E |
| 4,899,604 | A * | 2/1990 | Morishita et al. | 74/7 A |

(Continued)

FOREIGN PATENT DOCUMENTS

| | | |
|---|---|---|
| GB | 225 757 | 12/1924 |
| JP | 6 213114 | 8/1994 |

(Continued)

*Primary Examiner* — Justin Krause
(74) *Attorney, Agent, or Firm* — Berenato & White, LLC

(57) ABSTRACT

The combustion engine starter with output pinion (18) comprises a front bearing (12) provided with a front face (120) having an opening (312), a drive assembly equipped with a bush (26) passing through the opening (312) and bearing the output pinion (18) outside the front bearing (12), complementary splines (67,167). A groove (64, 164) interrupts the splines (67) of the bush (26) in order to mount a stop (60, 160) for immobilizing the pinion, a play-compensating spring (61) urging the pinion into contact with the stop (60, 160) formed by a spring ring which has a height greater than its thickness and which is housed with radial clearance at least partially in an annular recess (62) made in the front face (183) of the pinion (18); the internal periphery of the spring ring (60, 160) being mounted in the groove (64, 164) in the bush (26).

16 Claims, 2 Drawing Sheets

(56) References Cited

U.S. PATENT DOCUMENTS

| | | | | |
|---|---|---|---|---|
| 4,958,530 | A * | 9/1990 | Jaseck et al. | 74/7 A |
| 5,163,335 | A * | 11/1992 | Isom et al. | 74/6 |
| 5,432,384 | A * | 7/1995 | Isozumi et al. | 290/48 |
| 6,450,914 | B1 * | 9/2002 | Irwin et al. | 475/230 |
| 6,791,201 | B2 * | 9/2004 | Murata et al. | 290/38 R |
| 2002/0047269 | A1 | 4/2002 | Murata et al. | |
| 2013/0087016 | A1 * | 4/2013 | Koudu et al. | 74/7 A |

FOREIGN PATENT DOCUMENTS

| | | |
|---|---|---|
| JP | 2004 183586 | 7/2004 |
| KR | 2008 0110080 | 12/2008 |

* cited by examiner

COMBUSTION ENGINE STARTER WITH OUTPUT PINION

CROSS-REFERENCE TO RELATED APPLICATIONS AND CLAIM TO PRIORITY

This application is a national stage application of International Application No. PCT/FR2011/050513 filed Mar. 15, 2011, which claims priority to French patent application Ser. No. 10/51975 filed Mar. 19, 2010, of which the disclosures are incorporated herein by reference and to which priority is claimed.

FIELD OF THE INVENTION

The present invention relates to a combustion engine starter equipped with a starter head with an output pinion, in particular for a motor vehicle.

CURRENT STATE OF THE ART

Such a starter is described for example in documents FR 2 745 855 and U.S. Pat. No. 4,818,889 to which reference will be made for further details.

This starter comprises a housing within which is mounted an electric motor of which the shaft is designed to rotatably drive an output shaft of the starter carrying and meshing with a driver belonging to a starter head including an output pinion, which is disposed outside the housing.

Depending on the application, the output shaft of the starter is, as in the document FR 2 745 885, combined with the shaft of the electric motor or, as in the document U.S. Pat. No. 4,818,889, separate from the shaft of the electric motor.

The housing of the conventional starter comprises a front bearing configured for attaching the starter on a fixed part, a frame and a rear bearing for rotatably mounting the rear end of the shaft of the electric motor.

The frame carries the inductor, such as magnets or windings, of the electric motor surrounding a wound armature integral with the motor shaft. The frame is interposed axially between the front and rear bearings.

In the documents FR 2 745 855 and U.S. Pat. No. 4,818,889, the starter head has a metal bush having a front end passing through an opening in the front bearing and the pinion is disposed on the outside of the front bearing on the front end of the bush. A roller type free wheel is interposed between the driver and the rear end of the bush.

The driver is configured to mesh with the output shaft of the starter through a splined connection with complementary helical grooves. When the electric motor rotates, the starter head and the pinion are thus able to move axially and rotationally by the fact that the output shaft of the starter carries the helical gear driver.

This pinion in the forward position is designed to mesh with the teeth of a starting ring gear directly or resiliently connected to the crankshaft of the combustion engine to be started.

In the document FR 2 745 885 the pinion is integral with the front end of the bush so that the number of teeth of the pinion is limited and the pinion is made of the same material as the bush forming the cylindrical main body of the pinion.

In the document U.S. Pat. No. 4,818,889 these disadvantages are not present in that the pinion is separate from the bush which has a nose at its front end. The pinion is rotatably connected to the nose by a connection with complementary splines provided between the outer periphery of the nose and the inner periphery of the pinion. This connection allows an axial movement of the pinion relative to the bush. There is provided a stop to limit the axial movement of the pinion, and a stop ring to axially immobilise the stop in combination with a play-compensating spring bearing on a shoulder of the nose to axially urge the pinion into contact with the stop. The spring is compressed during assembly of the stop and the ring. The ring is received in a seating and in a semi-cylindrical groove formed respectively in the stop and in the nose.

Three additional parts are thus required to fit the pinion.

In the document U.S. 2002/0047269 there is also provided an additional part for retaining a resilient ring, namely a cover mounted in a groove formed in an extra thickness provided at the front the pinion. An axial play exists between the cover and the front end of the bush.

The pinion is additionally configured at the rear to present an extra thickness adjacent to a stop formed in the bush. This stop prevents inclination of the pinion relative to the bush.

In all cases there is an increase in the axial dimensions.

There is a perceived need to reduce the number of parts and to reduce the axial dimensions.

OBJECT OF THE INVENTION

The object of the present invention is to meet this need.

According to the invention a combustion engine starter having a centrally-holed output pinion, in particular for a motor vehicle, comprising a housing with a front bearing having a front face provided with an opening, a starter head fitted with a bush having a front end passing through the opening in the front bearing and carrying the output pinion outside the front bearing, complementary splines belonging respectively to the outer periphery of the front end of the bush and to the inner periphery of the output pinion, a groove interrupting the splines of the bush for mounting a stop for axially immobilising the pinion, a play-compensating spring urging the pinion into contact with the stop, wherein, on one hand, the front end of the bush has a shoulder for supporting the rear end of the spring and, on the other hand, the pinion has at the rear a blind seating for mounting the spring, is characterised in that the stop is formed by a resilient ring having a height greater than its thickness, in that the resilient ring is housed with radial clearance at least partially in an annular recess formed in the front face of the pinion, and in that the inner periphery of the ring is mounted in the groove of the bush.

By virtue of the invention the number of parts for assembling the pinion with the bush is reduced, the ring of the prior art being eliminated. The stop is simplified in that it comprises a resilient ring less massive than the stop of the prior art and of greater diameter.

In addition the solution is, on one hand, more compact axially by virtue of the fact that the resilient ring is mounted at least partially in the recess and, on the other hand, avoids ejection of the stop under the effect of centrifugal force by cooperation of the resilient ring with the outer rim of the recess.

The solution is therefore robust and reliable in that it avoids a separation of the pinion relative to the bush.

Furthermore, the pinion and the bush are easy to manufacture. The outside diameter of the pinion can be of the desired value.

By virtue of the invention it is therefore possible to increase the size and number of teeth of the pinion, for example in order to drive and follow the combustion engine at a higher speed or to obtain a better operating point. The strength of the pinion is not unduly weakened and the axial dimensions are reduced.

According to other features taken alone or in combination:

the outer periphery of the resilient ring is disposed entirely within the recess;

the resilient ring is split;

the resilient ring is a snap-ring;

the resilient ring has inclined resilient tabs at its inner periphery;

the outside diameter of the resilient ring is greater than the outside diameter of the play-compensating spring;

the opening in the front bearing is formed by the internal bore of a sleeve of the front bearing facing in the opposite direction to the pinion;

the sides of the groove are parallel.

In all cases use is made of a standard economical resilient ring that is not conditioned by the effects of centrifugal force.

The rotational speed of the starter is not conditioned by the deformation and/or opening of the resilient ring.

The material of the resilient ring or its configuration are not conditioned by the rotational speed of the starter.

Other features and advantages of the invention will become apparent on reading the following description with reference to the accompanying drawings.

DESCRIPTION OF EXAMPLE EMBODIMENTS OF THE INVENTION

In FIGS. 1 to 5 the elements common to the invention and to those of the document FR 2 745 855 are assigned the same references.

Figure 1:
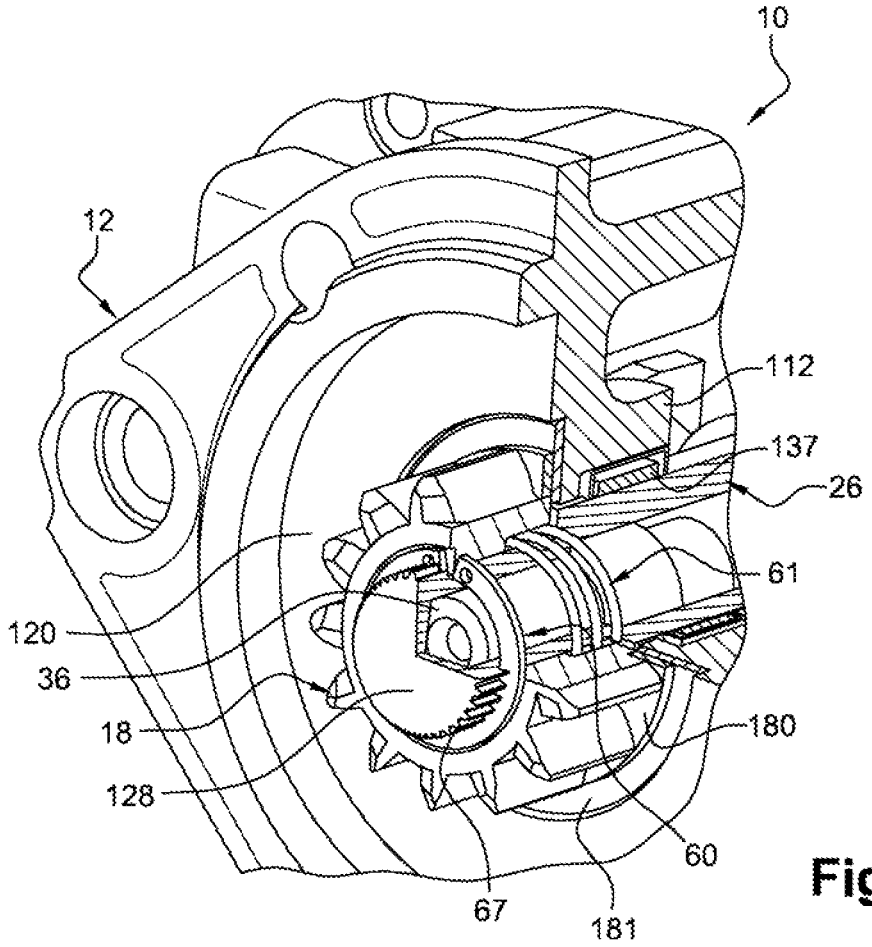
FIG. 1 is a partial cut-away perspective view of a combustion engine starter equipped with an output pinion according to a first embodiment of the invention, the said pinion being in the retracted idle position.
Figure 2:
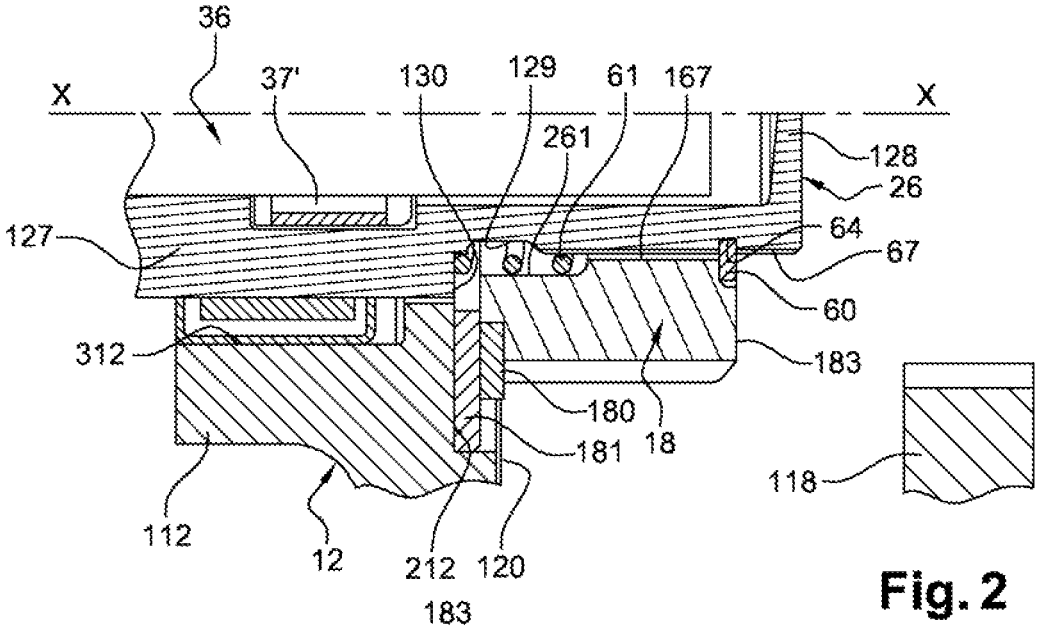
FIG. 2 is a partial half-view in axial cross-section of the starter in FIG. 1.

FIGS. 1 and 2 show the front end of the starter 10 of a combustion engine 30 of a motor vehicle.

Reference 12 denotes the front bearing of the housing of the starter 10, reference 26 denotes the front part of the starter head of the starter 10, reference 18 denotes the output pinion of the starter head of the starter 10, and reference 36 denotes the smooth axial front end of the shaft of the electric starter motor, of which the axis is referenced X-X in FIG. 2.

The pinion 18 is referred to as an output pinion because it is disposed outside the housing 12.

In the following description an orientation from back to front corresponds FIG. 1 to an orientation from right to left.

In the following description the transverse, axial and radial orientations will be defined relative to the axis X-X, which is the axial axis of symmetry of the part 26 and of the end 36. This axis also defines the centre of an opening 312 formed in the front face 120 of the front bearing 12.

In the figures, no modification is made to the electric motor shaft, the rear end of the starter head and the splined connection with complementary helical grooves between the electric motor shaft and the driver of the document FR 2 745 855.

The front portion 26 of the starter head therefore constitutes a very hard main body as the rear end of this body forms a track for the rollers of the free wheel provided between this body and the driver of the starter head.

In the figures and in the document FR 2 745 855 this body is cylindrical in shape with an axial axis of symmetry X-X. The body 26 is internally hollow for receiving the end 36 of the shaft of the electric motor, thus penetrating into the body 26.

The cylindrical body 26 is metallic and thus consists of a bush which according to a particular feature is separate from the pinion 18.

The front end of the bush 26 passes through, in the manner described below, the opening 312 in the bearing 12, which emerges in the front face 120 of the bearing 12.

The front bearing 12 is hollow in form and configured so as to be attached on a fixed part and for carrying an electromagnetic contactor (not shown). It is made of metal in this case, for example aluminium, in order to obtain the desired shapes.

The pinion 18 is arranged so as to be rotationally and axially movable between an idle position shown in FIGS. 1 and 2, and a forward position, in which the pinion meshes with the starting ring 118 (FIG. 2) integral with a flange, such as a flywheel, connected rigidly or resiliently to the crankshaft of the combustion engine in order to start the latter.

The axial displacements of the pinion are here controlled by a fork, also referred to as a fork-shaped element in the document FR 2 745 855, acting on the driver of the starter head. This fork is articulated at an intermediate point on the front bearing 12 of the housing. A splined connection with complementary helical grooves is provided between the electric motor shaft and the driver of the starter head locally surrounding this shaft.

Reference will be made is document FR 2 745 855 for more details.

The fork is designed to be actuated by the electromagnetic contactor described for example in WO 2004/088126 and WO 03/002870 to which reference will be made for more details; these documents also show the electric motor and the rear bearing and the frame of the starter. This fork is connected, in a known manner and shown for example in FIG. 6 of WO 2004/088126, at its upper end to the movable core of the contactor, configured to act on a pusher, in the form of a rod, carrying a movable contact, in the form of a plate, arranged to come into contact with two power supply terminals for powering the electric motor of the starter in order to rotatably drive the starting ring 118 of the combustion engine of the motor vehicle when the pinion 18 and the bush 26 are in the forward position and in engagement with the ring gear.

One of the terminals is intended to be electrically connected to the positive terminal of the battery of the motor vehicle. The other terminal is intended to be electrically connected to the electric motor of the starter.

The contactor also includes a fixed core, at least one coil and also springs, in particular return springs to return the movable core to the idle position. When the driver actuates the ignition key or inserts a starting card, a contact is caused to close and the contactor coil is electrically energized so that the movable core is moved towards the fixed core and moves the fork and the pusher. After a given travel the movable contact comes into electrical contact with the terminals and the electric motor is electrically energized and causes the output shaft of the starter to turn.

The bush 26 is axially guided by bearing means 137, 37' acting, on one hand, between the bush 26 and the bearing 12 and, on the other hand, between the bush 26 and the smooth end 36 of the electric motor shaft seated in the bush 26. The bearing means 37' provided between the smooth outer periphery of the axial end 36 and the stepped-diameter inner periphery of the bush 26 can consist of sleeve bearings, as in the documents FR 2 745 885 and U.S. Pat. No. 4,818,889.

The bearing means 137 provided between the outer periphery of the bush 26, also stepped in diameter, and the front bearing 12 can include a ball bearing as in the document U.S. Pat. No. 4,818,889, a roller bearing or a sleeve bearing as in the document FR 2 745 855.

The bearing means 37', 137 consist in this case of needle bearings for axially guiding the bush 26. It all depends on the applications.

As can better be seen in FIGS. 1 and 2, the bush 26 has a front end 126, 127 which passes through the opening 312 of the front bearing 12 and carries out the output pinion 18 outside the front bearing 12. This pinion 18 has a central hole. The edge of the hole forms the inner periphery of the pinion 18.

The mounting of the pinion 18 on this front end 126, 127 comprises:

- complementary splines 67, 167 belonging respectively to the outer periphery of the front end of the bush and the inner periphery of the output pinion;
- a stop 60 for axially immobilising the pinion 18;
- a first groove 64 interrupting the splines 67 of the bush for mounting the stop 60;
- a play-compensating spring 61 urging the pinion 18 into contact with the stop 60;
- a shoulder 130 belonging to the front end of the bush to support the rear end of the spring 61;
- a blind recess 261 for mounting the play-compensating spring 61, present at the rear of the pinion 18.

In the embodiment shown in FIG. 2 the spring 61 is a helical spring, also referred to as a coil spring.

In FIGS. 1-5 this assembly includes a stop 60, 160 and a spring 61. The front end 126, 127 of the bush 26 is stepped in diameter.

More precisely, this front end of the bush 26 has a first portion 127 extended axially by a second portion 126 of reduced outside diameter relative to that of the first portion 127. This second portion 126 belongs to the free end of the bush 26 of the starter head. The front face 128 of this portion 126 is closed (FIGS. 1 and 2).

In a variant, the second portion 126 is closed internally at the front by a washer as shown in FIG. 1 of the document FR 2 745 855.

According to a particular feature, the pinion 18 is fitted on the second portion 126. The front face 128 of this portion 126 extends in axial projection relative to the front face 183 of the pinion 18.

All of these configurations are made possible by the fact that, according to a particular feature, the pinion 18 has a central hole and is separate from the bush 26 by being mounted and fitted on the second portion 126 by the aforementioned assembly.

The outside diameter of the pinion 18 is here greater than the outside diameter of the bush 26, that is the outside diameter of first portion 127. In this embodiment the root circle diameter of the pinion 18 is greater than the outside diameter of the first portion 127. The number of teeth of the pinion 18 is therefore not imposed by the size of the bush 26.

The second portion 126 is designed to extend outside the starter housing. In this embodiment it is disposed for the most part outside the front bearing 12 when the pinion 18 is in the idle position. When the pinion 18 moves axially and rotationally from its idle position to its forward meshing position with the ring gear 118, the second portion 126 is caused to extend entirely outside the front bearing 12 and the first portion 127 partially outside the bearing 12.

The front end 126, 127 of the bush therefore passes through the front bearing 12.

The outside diameter of this second portion 126 is less than the outside diameter of the first portion 127.

The inside diameter of the first portion 127 is greater than the inside diameter of the second portion 126.

The outside diameter of second portion 126 is greater than the inside diameter of the first portion 127.

These arrangements make it possible to have the required amount of material for mounting the gear 18 on the second portion 126.

This also makes it possible to mount the needle bearings 37', 137.

The needle bearing 137 for axially guiding the bush 26 is disposed between the outer periphery of the first portion 127 and the stepped-diameter inner periphery of a sleeve 112, centrally disposed in the front bearing 12. The bearing 12 thus has a central hole, by virtue of the internal bore 312 in the sleeve 112, for passage of the sections 127, 126 of the bush 26 and the smooth front portion 36. The bush 112 is directed axially towards the inside of the bearing 12, that is to say in the direction opposite to the pinion 18. This makes it possible to obtain the desired size for the pinion 18, by having a front bearing with a front face 120 provided with an opening 312, which does not determine the size of the pinion by the fact that the bush 112 is directed inwardly.

In the retracted idle position (FIG. 1) the pinion 18 is in contact with a support carried by the front bearing 12 and the spring 61 is not fully compressed, its turns not being contiguous. In the embodiment shown this support consists of a washer 181 mounted in an annular transverse seating 212 formed in the front face 120 of the bearing 12 around the opening 312.

This opening 312 and this seating affect a wall of axial transverse orientation presented by the front face 120 of the bearing 12 of hollow shape as can be seen in FIGS. 1 and 2. In this embodiment in FIG. 2 the washer 181 is accommodated entirely within the seating 212 so as to reduce the axial dimension. In a variant it is mounted for the most part in the seating 212. In a variant it is bonded to the front face 120 of the bearing 12.

The rear face of the pinion 18 is closed by a washer 180 fitted to the rear face of the pinion provided with an annular groove (not referenced) for this purpose. A sealed contact is thus obtained when the pinion 18 is in the idle position, the washers 180, 181 then being in contact with each other. It will be noted that in FIG. 3 the washer 180 is not yet fitted to the rear of the pinion 18.

In a particular embodiment the washer 181 is made of an elastomer to reduce noise. The washer 180 is rigid.

The seating 212 is cylindrical in shape. It is delimited by a face oriented transversely relative to the axis X-X of the bush 26 and the end 36. This face is extended at its outer periphery by a face oriented axially relative to the axis X-X for centering the washer 181. The seating 212 has a central hole by the fact that the internal bore 312 of the bush 112 opens into this seating 212 for mounting the washer 181.

In a variant, the washer 181 is dispensed with and the transverse face of the seating 212 is machined to form the support for the rear end of the pinion 18. In a variant, the front face 120 of the bearing 12 is machined to form the support for the rear end of the pinion 18. The direct contact between the pinion 18 and the transverse face of the seating 212, being more or less deep, or the front face 120 of the bearing 12, makes it possible to reduce the length of the series of dimensions.

Due to the presence of the washer 180, a blind recess therefore exists between two consecutive teeth of the pinion 18. These recesses open at the front face 183 of the pinion 18.

In a variant, the washer 180 is integral with the pinion 18.

Of course, in a variant, the washer 180 is dispensed with.

The teeth of the pinion 18 are bevelled at the front face 183 of the pinion 18.

In a particular embodiment the pinion 18 is made of the same material as that of the bush 26, in this case metal.

In a variant, the material of the pinion 18 is different from that of the bush 26. In a particular embodiment the pinion 18 is made of sintered material.

This is made possible by the fact that the pinion 18 is mounted on the portion 126 by means of a spline assembly 67, 167. This mounting of the pinion 18 on the portion 126 of the bush 26 includes, according to a particular feature, a simplified stop in the form of a resilient ring 60, 160.

According to a particular feature, the height of the resilient ring 60, 160 is greater than its thickness.

The splines 67, 167 are formed in a complementary manner respectively at the outer periphery of the second portion 126 of the bush 26 and the inner periphery of the pinion 18 with central hole for the passage of the second portion 126 with chamfered free end.

The splines 67, 167 are axially oriented, that is to say straight splines, for mounting with the possibility of axial displacement of the pinion 18 relative to the second portion 126 and rotatable connection therewith.

According to a particular feature, the resilient ring 60, 160 is seated with radial clearance at least partially in an annular recess 62 formed in the front face 183 of the pinion 18. The recess 62 is transversely oriented.

Figure 5:
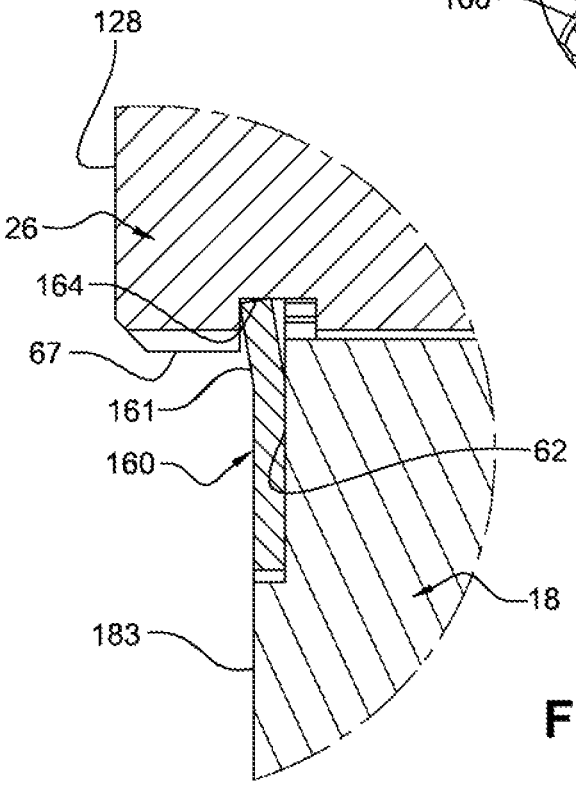
FIG. 5 is a partial sectional view of the assembly in FIG. 4.

In FIGS. 2 and 5 the outer periphery of the ring 60, 160 is housed entirely within the recess 62. The front face 183 of the pinion 18 is notched to form the recess 62, locally reducing the thickness of the pinion 18. The inner periphery of the recess 62 is delimited by the central hole of the pinion 18.

The splines 167 open at the front in the recess 62 at the inner periphery of this recess 62, which is of reduced size axially due to the fact that the height of the resilient ring 60, 160 is greater than its thickness. In all cases the strength of the pinion is not unduly weakened. The pinion is simplified compared to that described in the document U.S. 2002/0047269 in that it has no extra thickness. It is also lighter in weight.

This arrangement makes it possible to reduce the axial mounting dimensions of the pinion 18 on the front end portion 126 of the bush 26.

Furthermore the number of parts is not increased.

According to a particular feature, the inner periphery of the resilient ring 60, 160 is mounted in a first groove 64, 164 formed in the splines 67 of the second portion 126.

The first grooves 64, 164 are disposed in the vicinity of the front face 128 of the second portion 126.

The splines 67 are therefore interrupted at the front by the first groove 64, 164.

The first groove 64, 164 axially retains the ring 60, 160, which is thus a ring for axially locking and immobilizing the pinion 18.

It will be noted that in FIGS. 2 and 5 the sides of the first groove 64, 164 are parallel and perpendicular to the axis X-X, that is to say transversely oriented.

The splines 67, 167 open respectively in the front face 128 of the portion 126 and in the recess 62 in the front face 183 of the pinion 18.

The rear end of the second portion 126 is delimited by the front face 130 of the first portion 127. The rear end of the second portion 126 is provided with a groove 129 in proximity to the front face 130 of the portion 127.

More precisely

The pinion 18 has a central cylindrical seating 261 of axial orientation. The seating 261 is blind. It is open at the rear of the pinion 18, being delimited by a cylindrical wall axially oriented relative to the axis X-X. This wall is delimited at the front by a wall of generally semi-cylindrical shape for supporting the front end of the helical spring 61 mounted in the seating 261.

The rear end of the spring 61 bears on the front face 130 of the first portion 127.

The front face 130 of the first portion 127 therefore constitutes a supporting shoulder for the rear end of the spring 61, which in this case is a play-compensating spring urging the pinion into contact 18 with the stop 60, 160.

According to a particular feature, a second groove 129 is offset axially towards the front relative to the front face 130 of the portion 127 for centering the rear turn of the spring 61 and therefore the rear end of the spring 61.

Thus the second portion 126 has a second groove 129 of which the rear end is close to the front face 130 of the first portion 127.

More precisely, as shown in FIG. 2, a surface (not referenced) for retaining the rear end of the spring 61 exists between the shoulder 130 and the second groove 129 comprising a cylindrical bottom. The spring 61 being a helical spring in this embodiment, this retaining surface has a length such that it centres the last turn of the spring 61 in bearing contact against the shoulder 130.

The semi-cylindrical wall of the seating 261 has a shape complementary to the front turn of the spring 61.

The axial length of the splines 167 of the pinion 18 is less than the axial length of the splines 67 of the second portion 126.

The splines 67 of the portion 126 open at the rear in the second groove 129, of which the depth is greater than or equal to the depth of the splines 67 for machining thereof. The diameter of a bottom of the second groove 129 (FIG. 2) is greater than the inside diameter of the portion 127. The second groove 129 is delimited axially by two sides connecting respectively to the retaining surface and to the splines 67. The side associated with the splines 67 is inclined, whereas the other side associated with the retaining surface is of generally radial orientation.

The splines 167 of the internal bore of the pinion 18 open at the front in the recess 62 and at the rear in the seating 261. In this embodiment the axial length of the splines 167 is greater than the axial length of the seating 261 and less than the length of the splines 67.

The end of the portion extends in axial projection relative to the front face 183 of the pinion 18.

In the embodiments of FIGS. 1 to 5 the radially-oriented recess 62 is annular in shape and has a bottom oriented transversely relative to the axis X-X. This bottom is extended at its outer periphery by a cylindrical rim of axial orientation relative to the axis X-X.

The diameter of the rim of the recess 62 is greater than the outside diameter of the resilient ring 60, 160. This diameter of the rim of the recess 62 is in this case close to the outside diameter of the ring 60, 160. A radial clearance therefore exists between this edge and the outer periphery of the resilient ring 60, 160. An annular band of material is disposed between the outer periphery of the recess 62 formed by the edge of the recess 62 and the root circle of the pinion 18.

The thickness of this band depends on the application so as to have the requisite mechanical strength for the teeth of the pinion 18.

This arrangement permits easy mounting of the ring 60, 160 in the recess 62 and in the groove 64, 164 concerned. It also makes it possible to radially retain the resilient ring 60, 160 in case of overspeed of the starter. It prevents ejection of the ring 60, 160 and demounting of the pinion 18, given that the ring 60, 160 is sensitive to the effects of centrifugal force by the fact that its height is greater than its thickness.

The axial depth of the recess 62 is a function of the thickness of the ring 60, 160. In this case the axial depth of the recess 62 is greater than or equal to the thickness of the ring 60, 160 to ensure effective coverage of the ring 60, 160 by the pinion 18 and effective radial retention of the ring 60, 160. The thickness of the ring 60, 160 is less than the inside diameter of the ring 60, 160. The radial height of the ring 60, 160 is greater than the axial thickness of this ring.

The outside diameter of the recess 62 is greater than the diameter of the axially-oriented cylindrical wall of the seating 261 and therefore greater than that of the splines 67, 167. The outside diameter of the recess 62 is thus greater than the outside diameter of the spring 61 mounted in the seating 261. In this case the spring 61 is a helical type spring.

In the two embodiments of FIGS. 2 and 5, the depth of the groove 64, 164 is a function of the depth of the splines 67, 167. In this case the grooves 64, 164 are deeper than the splines 67, 167.

The spring 61 is used to create mounting clearances and/or to serve as a shock absorber for the pinion 18, especially when a tooth of the pinion 18 comes into contact with a tooth of the ring gear 118. The spring 61 therefore has a dual function. As can be seen in FIG. 2, when the pinion 18 is in the retracted idle position the turns of the spring 61 are not contiguous; the front face of the washer 181 being offset axially towards the front relative to the shoulder 130. The spring 61 can have a large axial length while being effectively held in place in particular by the aforementioned retaining surface. The spring 61 operates effectively in these conditions.

The spring 61 is also used to facilitate mounting of the resilient ring 60, 160 in the recess 62.

Mounting of the spring 61, the pinion 18 and the resilient ring 60, 160 is accomplished in the final stage after assembling the other elements of the starter.

More precisely, the bush 26 being in a position corresponding to the retracted idle position of the pinion 18 and therefore of the starter, in a first step the spring 61 is threaded axially onto the portion 126 projecting relative to the bearing 12. At the end of this first step the spring 61 bears on the shoulder 130 formed by the front face 130 of the first portion 127.

In a second step the pinion 18 is threaded axially onto the portion 126. At the end of this second step the pinion abuts against the spring 61.

In a third step, with the pinion in bearing contact by its front face 183 against an annular stop with central hole for the passage of the resilient ring 60, 160, the electromagnetic contactor of the starter is energised electrically to move the movable core of the latter and the fork.

The bush is then moved forward. The spring 61 is compressed, the groove 64 is then accessible and the recess 62 is cleared thereby enabling the resilient ring to be mounted easily in its groove 64, 164. Of course the length of the spring 61 is determined so that its turns do not come into contiguous contact before the groove 64 becomes accessible.

In a fourth step, the power supply to the contactor is shut off so that the spring 61 expands and pushes the pinion axially forward so that it bears on the rear face of the ring 60, 160 via its transversely oriented bottom of the recess 62. The pinion then radially covers the ring 60 (FIG. 2).

Finally the position illustrated in FIG. 2 is reached. The spring 61, bearing on the front face 130, pushes the pinion 18 so that the transverse bottom of the recess makes contact with the rear face of the ring 60, 160.

To disassemble the ring 60, 160 the procedure described in the third step is carried out in order to gain access to the ring 60, 160.

Figure 3:
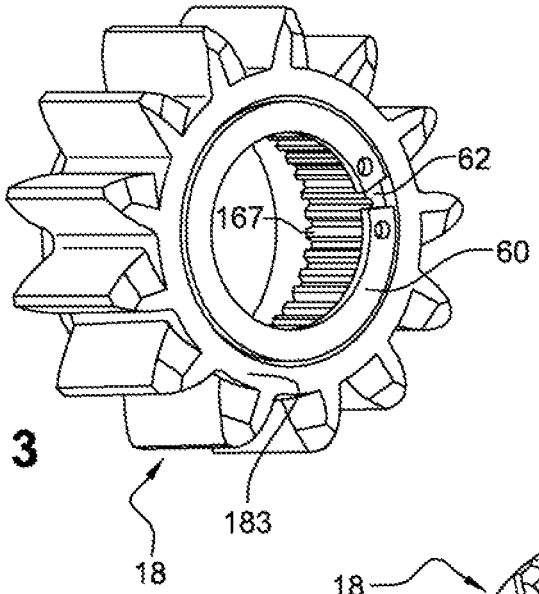
FIG. 3 is a perspective view of the resilient ring of FIGS. 1 and 2 mounted in the recess of the pillion.
Figure 4:
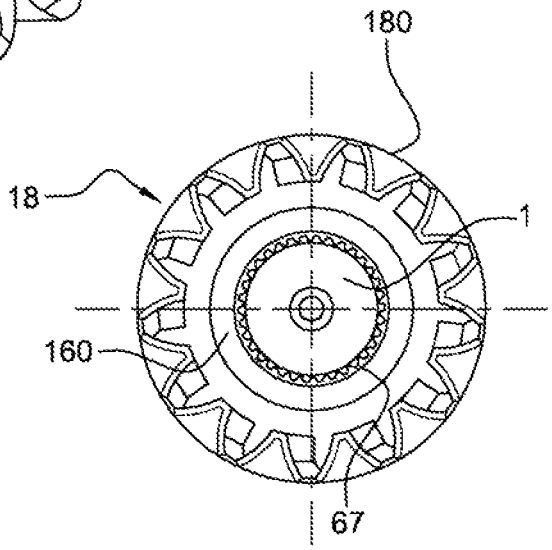
FIG. 4 is a front view showing the assembled output pinion assembled to the free end of the starter head in a second embodiment of the invention.

In the embodiment of FIGS. 1 to 3, the width of the groove 64 is generally equal to the thickness of the resilient ring 60.

In practice a clearance is provided for mounting the ring 60 in its parallel-sided groove 64. The inner periphery of the ring 60 is effectively retained by cooperation of forms in particular with the parallel sides of the groove 64.

This retaining action is effective by the fact that, in this embodiment, the groove 64 is deeper than the splines 67. Machining of the groove 64 is easy to carry out.

It is accomplished for example by turning on a lathe.

The anchoring of the ring 60 in the groove 64 is robust.

The ring 60 in FIGS. 1 to 3 consists of an open ring of the standard type with a gap, which separates the two circumferential ends of the ring.

In this embodiment the split ring 60 consists of a snap-ring.

More precisely, the circumferential ends of the ring 60 are each provided with a hole (not referenced in FIGS. 1 and 3) for receiving the ends of the jaws of pliers, referred to as snap-ring pliers, serving to open the ring and increase its diameter for mounting the ring in its groove 64 and for the removal thereof. By virtue of the invention, the ring 60 mounted in its groove 64 is not ejected under the effect of centrifugal force even if the starter head of the starter is rotating at high speed because on opening it abuts against the axially-oriented cylindrical rim of the recess 62. The recess serves to radially cover the ring 18 and limits the opening of the resilient ring. The radial clearance between the rim of the recess 62 and the outer periphery of the resilient ring 60, in the form of a snap-ring, depends on the application and in particular on the rotational speed of the starter head of the starter. The solution is an economical one in that the ring 60 for axially blocking the pinion 18 is a part of the standard type.

More precisely, it would have been possible to design a specific resilient ring of a non-standard type which does not open at the maximum rotational speed of the starter head, and it would have been possible to limit the maximum rotational speed of the starter head to the opening speed of the resilient ring.

The present invention makes it possible to use a resilient ring of the standard type while not being limited in terms of the rotational speed of the starter head.

In a variant (FIGS. 4 and 5) the resilient ring 160 is a ring of the standard type which has resilient tabs 161 inclined relative to the ring 160 at an oblique angle at the inner periphery of the ring 160. In this case the groove 164 is widened to accommodate the resilient tabs 161.

The tabs 161 are mounted by snapping into the groove 164.

More precisely, the pinion being as aforementioned in the retracted position and the spring 61 compressed, the tabs 161 are threaded onto the front end of the portion 126. By virtue of their resilience, the tabs deform then relax as they enter the appropriately sized groove 164.

This is possible by the fact that the pinion is then in the retracted position, the groove 164 being wholly unobstructed.

The ring 160 cannot be ejected under the action of centrifugal force due to the presence of the recess 62, the tabs being unable leave the groove 164.

In all cases economical use is made of commercially available resilient rings and the recess 62 is in contact via its bottom with the rear face of the ring 60, 160. The rim of the recess serves as a radial stop to limit the radial expansion of the ring.

It will be appreciated that in the retracted idle position (FIG. 2) the pinion 18 is supported on the bearing 12 directly or indirectly via the washer 181 and that this support offers a large surface area. This support, provided by the front bearing 12, in the retracted idle position of the pinion, is preferably axially offset towards the front relative to the front face 130 of the portion 127 forming a bearing surface for the rear end of the spring 61. The diameter of this bearing surface is greater than that of the shoulder 130.

Of course, the present invention is not limited to the embodiments shown.

Thus, by way of a variant, as described in the document U.S. Pat. No. 4,818,889 (FIG. 1), the shaft of the electric motor is configured to form a pinion belonging to a reduction gear with planetary gear interposed between the electric motor shaft and the free wheel. In this case the splined connection with complementary grooves is provided between a sleeve belonging to the planet carrier of the reduction gear and the driver of the starter head with roller free wheel.

This sleeve is engaged with the driver of the starter head via a splined connection with complementary teeth of helical shape. This sleeve constitutes the output shaft of the starter.

In this case the assembly according to the invention between the pinion and bush of the drive assembly replaces the assembly in FIG. 1 of the document U.S. Pat. No. 4,818,889.

In this case the diameter of the pinion may be limited by the sleeve directed towards the outside of the bearing and partially surrounding the pinion.

This problem does not arise in the embodiment of FIG. 1.

In a variant, the output shaft of the starter is in the axial extension of the output shaft of the electric motor as can be seen for example in FIG. 6 of the document WO 2004/0881 cited above.

In a variant, the sleeve 312 is extended forward as in the document FR 2 764 946. In this case the opening 312 affects the front transverse wall of the front bearing 12 of hollow shape. This bearing is then generally ogive-shaped at the front.

A seal may therefore be provided, inside the front bearing at the level of the needle bearing as in the document FR 2 764 946.

In the embodiment of FIG. 1 the electromagnetic contactor extends parallel to the electric motor of the starter and is carried by the front bearing 12. In a variant, there is provided a return device between the fork and the movable core of the starter an that in this case the contactor extends to the rear of the electric motor.

The presence of the fork is not necessary, the contactor may include a coil surrounding the driver of the free wheel constituting the plunger core of the contactor.

The starter may or may not be equipped with a reduction gear.

In a variant, the free wheel of the starter is a conical clutch provided between the driver and the rear end of the bush as described for example in the document WO 03/002870.

The assembly of the starter frame to the front and rear bearings of the housing can be accomplished in any manner.

For example there are provided tie-rods (see FIG. 1 of U.S. Pat. No. 4,818,889) or screws (See FIG. 6 of WO 2004/088126) for assembling the rear bearing to the front bearing with the frame interposed.

The starter can be used to drive the internal combustion engine of a passenger vehicle, a truck, a farm tractor or a boat. In a variant, the starter is a starter for a fixed internal combustion engine used for example to drive a power take-off.

In FIGS. 1 to 5 the rim of the recess axially covers the outer periphery of the ring 60, 160 entirely.

In a variant, the rim of the recess covers the outer periphery of the ring 60, 160 for the most part. Thus, in a variant, the ring 60, 160 projects axially relative to the pinion 18 being housed for the most part in the recess. In all cases the ring 60, 160 presents at its outer periphery a front face which extends in axial projection relative to the front face 183 of the pinion 18.

By virtue of the invention the pinion 18 can be obtained by any suitable means, for example by extrusion, sintering, cutting from a bar, or stamping.

The pinion can be single-material or bi-material. For example, in a variant, the splines of the pinion are made of a material different from that of the teeth of the pinion. Thus, in a particular embodiment, the pinion is obtained by sintering two materials. This embodiment is advantageous in that the toothed part of the pinion is selected in a grade of material suited to the requirements of meshing with the ring gear 118 (wear resistance, low noise emission), whereas the inner portion of the pinion comprising the splines 167 and the seating 261 is selected so as to be suited to the requirements of sliding and mechanical strength in particular for supporting the spring 61.

In a variant, the second portion 126 has a different hardness from the hardness of the first portion 127 to facilitate smooth sliding of the pinion 18.

In a variant, the groove 129 is dispensed with, a rounded zone being provided to connect the front face 130 of portion 127 to portion 126.

In a variant, the spring 61, of the helical type in the figures, is of another type. In a variant, it is a stack of Belleville washers for example. In all cases the axial offset of the groove 129 relative to the shoulder 130 facilitates retention of the rear end of the spring 61 through which the portion 126 passes. The bush is additionally provided in that in the retracted idle position the pinion 18 bears directly or indirectly on the housing. The spring 61 also makes it possible to absorb shocks in particular when a tooth of the pinion makes contact with a tooth of the ring gear. In an aforementioned manner it facilitates mounting of the resilient ring 60, 160.

The invention claimed is:

1. A combustion engine starter comprising:

a housing with a front bearing (12) having a front face (120) provided with an opening (312);

a centrally-holed output pinion (18);

a starter head fitted with a bush (26) having a front end (126, 127) passing through the opening (312) in the front bearing (12) and carrying the output pinion (18) outside the front bearing (12);

complementary splines (67, 167) belonging respectively to an outer periphery of the front end of the bush (26) and to an inner periphery of the output pinion (18);

a first groove (64, 164) interrupting the splines (67) of the bush (26) for mounting a stop (60, 160) for axially immobilizing the pinion; and a play-compensating spring (61) urging the pinion into contact with the stop;

the front end of the bush (26) has a shoulder (130) for supporting a rear end of the spring (61);

the pinion (18) having at a rear a blind seating (261) for mounting the spring (61);

the stop (60, 160) formed by a resilient ring having a height greater than a thickness thereof;

the resilient ring (60, 160) housed with radial clearance at least partially in an annular recess (62) formed in a front face (183) of the pinion (18); and an inner periphery of the resilient ring (60, 160) mounted in the first groove (64, 164) of the bush (26).

2. The starter according to claim 1, wherein an outer periphery of the resilient ring (60, 160) is housed entirely within the recess (62).

3. The starter according to claim 1, wherein the outer periphery of the resilient ring (60, 160) is housed for partially within the recess (62).

4. The starter according to claim 1, wherein an outside diameter of the resilient ring (60, 160) is greater than an outside diameter of the play-compensating spring (61).

5. The starter according to claim 1, wherein the front bearing (12) has a sleeve (112) extending in the direction opposite to the pinion (18); and wherein the opening (312) in the front bearing (12) is composed of an internal bore of the sleeve (112) of the front bearing (12).

6. The starter according to claim 1, wherein the resilient ring (60) is split.

7. The starter according to claim 6, wherein the resilient ring (60) is a snap-ring.

8. The starter according to claim 5, wherein the resilient ring (160) has resilient tabs on the inner periphery thereof, the resilient tabs inclined relative to the ring (160) at an oblique angle.

9. The starter according to claim 1, wherein sides of the first groove (64, 164) are parallel; and wherein the first groove (64, 164) is deeper than the splines (67) of the bush (126).

10. The starter according to claim 1, wherein the front end (127, 126) of the bush (26) is stepped in diameter and has a first portion (127) extended axially by a second portion (126) of smaller diameter on which are formed the splines (67) of the bush (26); and wherein the shoulder (130) of the bush (26) is formed by a front face of the first portion (127).

11. The starter according to claim 10, wherein the second portion (126) has a second groove (129) a rear end of which is adjacent to the front face (130) of the first portion (127); and wherein the second groove (129) is offset axially relative to the shoulder (130) for centering the rear end of the spring (61).

12. A combustion engine starter comprising:

a housing with a front bearing (12) having a front face (120) provided with an opening (312);

a centrally-holed output pinion (18);

a starter head fitted with a bush (26) having a front end (126, 127) passing through the opening (312) in the front bearing (12) and carrying the output pinion (18) outside the front bearing (12);

complementary splines (67, 167) belonging respectively to an outer periphery of the front end of the bush (26) and to an inner periphery of the output pinion (18);

a first groove (64, 164) interrupting the splines (67) of the bush (26) for mounting a stop (60, 160) for axially immobilizing the pinion; and a play-compensating spring (61) urging the pinion into contact with the stop, the front end of the bush (26) has a shoulder (130) for supporting a rear end of the spring (61);

the pinion (18) having at a rear a blind seating (261) for mounting the spring (61);

the stop (60, 160) formed by a resilient ring having a height greater than a thickness thereof;

the resilient ring (60, 160) housed with radial clearance at least partially in an annular recess (62) formed in a front face (183) of the pinion (18);

an inner periphery of the resilient ring (60, 160) mounted in the first groove (64, 164) of the bush (26);

the front end (127, 126) of the bush (26) stepped in diameter and has a first portion (127) extended axially by a second portion (126) of smaller diameter on which are formed the splines (67) of the bush (26);

the shoulder (130) of the bush (26) formed by a front face of the first portion (127);

the second portion (126) having a second groove (129) of which a rear end is adjacent to the front face (130) of the first portion (127);

the second groove (129) offset axially relative to the shoulder (130) for centering the rear end of the spring (61);

a surface for retaining the rear end of the spring (61) is provided between the shoulder (130) and the second groove (129).

13. The starter according to claim 12, wherein an outside diameter of the second portion (126) is greater than an inside diameter of the first portion (127).

14. The starter according to claim 13, wherein the front bearing (12) carries a support (181) for the pinion (18).

15. The starter according to claim 14, wherein the support is formed by an elastomer washer (181) mounted in an annular transverse seating (212) formed in the front face of the front bearing (12).

16. A combustion engine starter comprising:

a housing with a front bearing (12) having a front face (120) provided with an opening (312);

a centrally-holed output pinion (18);

a starter head fitted with a bush (26) having a front end (126, 127) passing through the opening (312) in the front bearing (12) and carrying the output pinion (18) outside the front bearing (12);

complementary splines (67, 167) belonging respectively to an outer periphery of the front end of the bush (26) and to an inner periphery of the output pinion (18);

a first groove (64, 164) interrupting the splines (67) of the bush (26) for mounting a stop (60, 160) for axially immobilizing the pinion; and a play-compensating spring (61) urging the pinion into contact with the stop;

the front end of the bush (26) has a shoulder (130) for supporting a rear end of the spring (61);

the pinion (18) having at a rear a blind seating (261) for mounting the spring (61);

the front end (127, 126) of the bush (26) stepped in diameter and has a first portion (127) extended axially by a second portion (126) of smaller diameter on which are formed the splines (67) of the bush (26);

the shoulder (130) of the bush (26) formed by a front face of the first portion (127);

the second portion (126) having a second groove (129), a rear end of the second groove (129) being adjacent to the front face (130) of the first portion (127);

the second groove (129) offset axially relative to the shoulder (130) for centering the rear end of the spring (61).

* * * * *